US006995126B2

(12) United States Patent
Perkis et al.

(10) Patent No.: US 6,995,126 B2
(45) Date of Patent: Feb. 7, 2006

(54) POUCHED COMPOSITIONS

(75) Inventors: Kristin Nicole Perkis, Cincinnati, OH (US); Gregory Martin Gressel, Cincinnati, OH (US); Mark Anthony Manion, Cincinnati, OH (US); Nigel Patrick Somerville Roberts, Newcastle-upon-Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 117 days.

(21) Appl. No.: 10/279,589

(22) Filed: Oct. 24, 2002

(65) Prior Publication Data

US 2003/0050209 A1 Mar. 13, 2003

Related U.S. Application Data

(63) Continuation of application No. PCT/US01/07710, filed on Mar. 9, 2001.

(30) Foreign Application Priority Data

Apr. 28, 2000 (GB) ..... 0010229

(51) Int. Cl.
*C11D 17/04* (2006.01)

(52) U.S. Cl. ..... 510/296; 510/439

(58) Field of Classification Search ..... 510/296, 510/439

See application file for complete search history.

(56) References Cited

U.S. PATENT DOCUMENTS

| | | | | | |
|---|---|---|---|---|---|
| 4,082,678 | A | * | 4/1978 | Pracht et al. | 8/137 |
| 4,367,156 | A | * | 1/1983 | Diehl | 510/313 |
| 4,886,615 | A | * | 12/1989 | Dehan | 510/296 |
| 4,973,416 | A | | 11/1990 | Kennedy | 510/296 |
| 5,160,654 | A | * | 11/1992 | Falou et al. | 510/277 |
| 5,224,601 | A | | 7/1993 | Gouge et al. | 206/524.7 |
| 5,362,532 | A | * | 11/1994 | Famili et al. | 428/36.6 |
| 6,624,130 | B2 | * | 9/2003 | Giblin et al. | 510/297 |

FOREIGN PATENT DOCUMENTS

| | | | |
|---|---|---|---|
| EP | 0132726 | A2 * | 2/1985 |
| EP | 0236136 | A2 * | 9/1987 |
| EP | 0414482 | A2 * | 2/1991 |
| WO | WO 93/08091 | | 4/1993 |

* cited by examiner

*Primary Examiner*—Lorna M. Douyon

(74) *Attorney, Agent, or Firm*—Armina E. Matthews; Kim W. Zerby; Steven W. Miller

(57) ABSTRACT

A multi-compartment pouch is obtainable by a process of closing an open compartment with a pre-sealed compartment. The multi-compartment pouch comprises a detergent composition and is for use in automatic-washing or hand-washing applications.

9 Claims, No Drawings

POUCHED COMPOSITIONS

CROSS REFERENCE TO RELATED APPLICATIONS

This is a continuation of International Application PCT/US01/07710 with an international filing date of Mar. 9, 2001, published in English under PCT Article 21(2) which claims benefit of Great Britain Application No. 0010229.3, filed Apr. 28, 2000.

FIELD OF THE INVENTION

This invention relates to water-soluble pouches.

BACKGROUND TO THE INVENTION

The laundry industry has been trying to develop ways that minimise the contact between incompatible detergent ingredients during the manufacturing, transport and storage of detergent products prior to addition to the washing cycle.

One such way is the development of a multi-compartment water-soluble detergent pouch. Incompatible detergent ingredients are comprised by different compartments of said pouch in such a manner so that they do not come into contact with each other until said pouch dissolves or disintegrates in water during the washing cycle.

Examples of these multi-compartment pouches are described in U.S. Pat. No. 4,973,416 and U.S. Pat. No. 5,224,601. The use of compartments which can contain different detergent ingredients is designed to overcome the problems associated with the storage of incompatible detergent ingredients, since said ingredients do not come into contact during storage as they are in separate compartments.

The inventors have found that there is a risk of detergent ingredients leaking from multi-compartment pouches, in addition the inventors have found that detergent ingredients are more likely to leak from the seals of a multi-compartment pouch, especially when the compartments are sealed simultaneously, due to the poor seal strength. The risk of leakage is greater when one of the compartments comprises a liquid.

Furthermore, the inventors have found that if the compartments are sealed simultaneously, a process which requires unsealed compartments being in relatively close proximity, there is a risk that ingredients may leak from one unsealed compartment to another during the sealing process, due the lack of a seal to prevent the exchange of ingredients between the two compartments during the early stages of the sealing process. This is especially applicable if one or more of the ingredients is a liquid.

Herein, the inventors have found that by using a pre-sealed water-soluble compartment to close an unsealed compartment, thus forming a multi-compartment water-soluble pouch, said multi-compartment water-soluble pouch is more stable having a reduced risk of ingredients leaking from the seals of said pouch both during the manufacturing and storage of the pouch. This is due to the multiple seal that is formed by the above closing process. This is especially applicable if the pre-sealed water-soluble compartment comprises a liquid.

SUMMARY OF THE INVENTION

In a first embodiment of the invention, a multi-compartment pouch made from a water-soluble film and having at least two compartments is provided, said multi-compartment pouch is obtainable by the process of closing an open compartment with a pre-sealed compartment, the process forms a second seal on the pre-sealed compartment which is in a different position to the first seal of the pre-sealed compartment.

In a second embodiment of the invention, a process for making a multi-compartment pouch made from a water-soluble film and having at least two compartments is provided which comprises the step of closing an open compartment with a pre-sealed compartment.

DETAILED DESCRIPTION OF THE INVENTION

Multi-Compartment Pouch and Material Thereof

The multi-compartment pouch, herein referred to as "pouch", has at least two, preferably two compartments. The pouch herein is typically a closed structure, made of materials described herein, enclosing a volume space which preferably comprises a composition. Said composition is described in more detail herein. The pouch can be of any form, shape and material which is suitable to hold the composition, e.g. without allowing the release of the composition from the pouch prior to contact of the pouch to water. The exact execution will depend on for example the type and amount of the composition in the pouch, the number of compartments in the pouch, the characteristics required from the pouch to hold, protect and deliver or release the compositions.

The pouch may be of such a size that it conveniently contains either a unit dose amount of the composition herein, suitable for the required operation, for example one wash, or only a partial dose, to allow the consumer greater flexibility to vary the amount used, for example depending on the size and/or degree of soiling of the wash load.

The pouch is made from a water-soluble film, said film encloses an inner volume, said inner volume is divided into the compartments of the pouch. The exact process of making said pouch is described in more detail hereinafter The compartment of the pouch is a closed structure, made of materials described herein, enclosing a volume space which comprises the components. Said volume space is preferably enclosed by a water-soluble film in such a manner that the volume space is separated from the outside environment.

The term "separated" means for the purpose of this invention "physically distinct, in that a first ingredient comprised by a compartment is prevented from contacting a second ingredient if said second ingredient is not comprised by the same compartment which comprises said first ingredient".

The term "outside environment" means for the purpose of this invention "anything which cannot pass through the water-soluble film which encloses the compartment and which is not comprised by the compartment".

Preferably, the volume space of the open compartment is greater than the volume space of the pre-sealed compartment. Thus, it is preferred that the compartment of the pouch which is derived from the open compartment has a volume space which is greater than the compartment of the pouch which is derived from the pre-sealed compartment.

The pouch preferably comprises a composition, said composition may comprise a solid component or a liquid component. If the composition comprises a solid component and a liquid component, then it may be preferred that the solid component and liquid component are comprised by two different compartments, typically so that that said solid component and said liquid component are separated by a water-soluble film which acts as a barrier.

Preferably, if present the liquid component is comprised by the pre-sealed compartment and, upon formation of the pouch is comprised by the compartment of the pouch which is derived from the pre-sealed compartment. It may also be preferred that the pre-sealed compartment comprises a solid component, or that the open compartment comprises a liquid component, or that both the pre-sealed compartment and the open compartment comprise a solid component, or that both the pre-sealed compartment and the open compartment comprise a liquid component.

It may be preferred that a compartment which comprises a liquid component also comprises an air bubble, preferably the air bubble has a volume of no more than 50%, preferably no more than 40%, more preferably no more than 30%, more preferably no more than 20%, more preferably no more than 10% of the volume space of the compartment. Without being bound by theory, it is believed that the presence of the air bubble increases the tolerance of the pouch to the movement of liquid ingredients within the compartments of the pouch, thus reducing the risk of liquid ingredients leaking from the pouch.

The compartment is suitable to hold the components, e.g. without allowing the release of the components from the compartment prior to contact of the pouch to water. The compartment can have any form or shape, depending on the nature of the material of the compartment, the nature of the components or composition, the intended use, amount of the components etc.

Preferably, the composition is a composition to be delivered to water and thus the pouch and the compartment(s) thereof are designed such that at least one or more of the components is released at or very shortly after the time of addition to the water. It is especially preferred that at least one component is delivered to the water within 3 minutes, preferably even within 2 minutes or even within 1 minute after contacting the pouch to water. Thus, it is preferred that the compartment and preferably the pouch as a whole comprises material which is water-dispersible or more preferably water-soluble.

Preferred water-dispersible material herein has a dispersability of at least 50%, preferably at least 75% or even at least 95%, as measured by the method set out hereinafter using a glass-filter with a maximum pore size of 50 microns.

More preferably the material is water-soluble and has a solubility of at least 50%, preferably at least 75% or even at least 95%, as measured by the method set out hereinafter using a glass-filter with a maximum pore size of 50 microns, namely:

Gravimetric method for determining water-solubility or water-dispersability of the material of the compartment and/or pouch:

10 grams±0.1 gram of material is added in a 400 ml beaker, whereof the weight has been determined, and 245 ml±1 ml of distilled water is added. This is stirred vigorously on magnetic stirrer set at 600 rpm, for 30 minutes. Then, the mixture is filtered through a folded qualitative sintered-glass filter with the pore sizes as defined above (max. 50 micron). The water is dried off from the collected filtrate by any conventional method, and the weight of the remaining polymer is determined (which is the dissolved or dispersed fraction). Then, the % solubility or dispersability can be calculated.

The pouch is made from a water-soluble film. Preferred films are polymeric materials, preferably polymers which are formed into a film or sheet. The film can for example be obtained by casting, blow-molding, extrusion or blow extrusion of the polymer material, as known in the art.

Preferred polymer copolymers or derivatives thereof are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferably the polymer is selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, most preferably polyvinyl alcohols, polyvinyl alcohol co-polymers, polyvinyl alcohol ter-polymers, and hydroxypropyl methyl cellulose (HPMC).

The polymer can have any weight average molecular weight, preferably from about 1000 to 1,000,000, or even form 10,000 to 300,000 or even form 15,000 to 200,000 or even form 20,000 to 150,000.

Mixtures of polymers can also be used. This may in particular be beneficial to control the mechanical and/or dissolution properties of the compartment or pouch, depending on the application thereof and the required needs. For example, it may be preferred that a mixture of polymers is present in the material of the compartment, whereby one polymer material has a higher water-solubility than another polymer material, and/or one polymer material has a higher mechanical strength than another polymer material. It may be preferred that a mixture of polymers is used, having different weight average molecular weights, for example a mixture of PVA or a copolymer thereof of a weight average molecular weight of 10,000–40,000, preferably around 20,000, and of PVA or copolymer thereof, with a weight average molecular weight of about 100,000 to 300,000, preferably around 150,000.

Also useful are polymer blend compositions, for example comprising hydrolytically degradable and water-soluble polymer blend such as polylactide and polyvinyl alcohol, achieved by the mixing of polylactide and polyvinyl alcohol, typically comprising 1–35% by weight polylactide and approximately from 65% to 99% by weight polyvinyl alcohol, if the material is to be water-dispersible, or water-soluble.

It may be preferred that the polymer present in the film is from 60% to 98% hydrolysed, preferably 80% to 90%, to improve the dissolution of the material.

Suitable examples of commercially available water-soluble films include polyvinyl alcohol and partially hydrolysed polyvinyl acetate, alginates, cellulose ethers such as carboxymethylcellulose and methylcellulose, polyethylene oxide, polyacrylates and combinations thereof. Most preferred are films which comprises PVA polymers and have similar properties to films that are known under the trade reference M8630, as sold by Chris-Craft Industrial Products of Gary, Ind. US.

The film herein may comprise other additive ingredients than the polymer or polymer material. For example, it may be beneficial to add plasticisers, for example glycerol, ethylene glycol, diethyleneglycol, propylene glycol, sorbitol and mixtures thereof, additional water, disintegrating aids. It may be useful when the pouched composition is a detergent composition, that the pouch or compartment material itself comprises a detergent additive to be delivered to the wash water, for example organic polymeric soil release agents, dispersants, dye transfer inhibitors.

Process of Closing the Open Compartment

The pouch is obtainable by the process of closing an open compartment with a pre-sealed compartment. Said process comprises the step of closing an open compartment with a pre-sealed compartment. Said process forms a second seal in a different position to the first seal of the pre-sealed compartment. Preferably, said second seal has a greater equivalent surface diameter than the first seal of the pre-sealed compartment.

The process of closing the open compartment closes the open compartment to obtain a closed compartment, said process of closing an open compartment with a pre-sealed compartment is herein referred to as "process of closing".

An open compartment has a volume space that is not separated from the outside environment. The process of closing the open compartment forms a compartment that has a volume space which is separated from the outside environment, such a compartment is a closed compartment, such as a compartment of the multi-compartment pouch of the invention.

The formation of the open compartment can be done by any known method. Typically, the open compartment is formed by fitting a water-soluble pouch around a mold and vacuum pulling the film so that it is flush with the inner surface of the mold, thus forming a volume space which is not separated from the outside environment, said volume space being the vacuum formed indent or niche in said water-soluble film. Preferred open compartments are made by introducing the film to form the compartment to a mold, then applying a vacuum to the mold, so that the material adopts the shape of the mold, also referred to as vacuum-forming. Another preferred method is thermo-forming to get the material to adopt the shape of the mold.

The process of closing typically comprises the steps of;

(i) bringing into close proximity the pre-sealed compartment and the open compartment, preferably so that at least part of the water-soluble film which encloses the volume space of the pre-sealed compartment also partially encloses the volume space of the open compartment; and (ii) closing the open compartment by a sealing process, said sealing process forms a seal on the open compartment to close said compartment and also forms a second seal on the pre-sealed compartment at a different position to the seal already present.

If a mold is used in the process for producing the pouch, especially if a mold is used in the process step of closing the open compartment with a pre-sealed compartment, then preferably the pre-sealed compartment is formed in a different mold to the mold used to close the open compartment with the pre-sealed compartment.

Preferably, the open compartment is closed with the same material as the material of the open compartment. The closing material, and thus preferably also the open compartment material, is preferably thermoplastic so that it can be closed by heat-sealing. Alternatively, a thermoplastic coating may be provided, either over the whole material or just in the areas where seals are to be formed. The sealing can also be made by solvent welding. Suitable heat-sealable materials include polyvinyl alcohol, polyvinyl acetate, polyvinyl pyrrolidone, polyethylene oxide, acrylic resins and mixtures thereof, in particular polyvinyl alcohols (PVA). These heat-sealable materials may also be used in combination with the other water-soluble or water-dispersible materials.

The pre-sealed compartment is typically already sealed prior to contact to the open compartment in such a manner so that any ingredient comprised in the volume space of the pre-sealed compartment is separated from the outside environment. The pre-sealed compartment typically comprises at least one seal, preferably only one seal, prior to the process of closing the open compartment.

Typically, the seal formed by the process of closing, has a greater equivalent surface diameter than the seal already present on the pre-sealed compartment. By greater equivalent surface diameter, it is typically meant that the diameter of the second seal is longer than the diameter of the first seal. Typically, the seal formed by the process of closing closes the open compartment, adds a second seal to the pre-sealed compartment, and forms a multi-compartment pouch by structurally bringing together the open compartment and pre-sealed compartment to form a multi-compartment pouch.

Composition

The pouch preferably comprises a composition, typically said composition is contained in the volume space of the compartments of the pouch.

Typically, the composition comprises such an amount of a cleaning composition, that one or a multitude of the pouched compositions is or are sufficient for one wash.

Preferably, the composition comprises at least one surfactant and at least one building agent.

The composition may comprises a solid component and a liquid component. Preferably the pre-sealed compartment comprises a liquid component. Said liquid component and solid component are described in more detail herein.

Liquid Component

If present, the liquid component is comprised by a compartment of the pouch. Preferably, said compartment is a different compartment to the compartment that comprises the solid component. The term "liquid component" includes components in the form of a viscous liquid and/or a gel.

The liquid component preferably comprises (by weight of the liquid component) at least 50%, preferably at least 55%, more preferably at least 60%, more preferably at least 70%, more preferably at least 80% surfactant. Typically the surfactant is a liquid at room temperature. Preferably, the surfactant is a nonionic surfactant, an anionic surfactant or a combination thereof, most preferably the surfactant is a nonionic surfactant.

Preferably, said liquid component of the invention comprises a solvent or a perfume. Preferably, said liquid component comprises (by weight of the liquid component) at least 2%, more preferably at least 5%, more preferably at least 10%, more preferably at least 40% perfume. Preferably, said liquid component comprises (by weight of liquid component) from 0.1% to 30%, more preferably from 5% to 25%, more preferably from 10% to 20% solvent. Preferably said solvent is an alcohol based solvent, more preferably said solvent is ethanol and/or n-butoxy propoxy propanol.

Preferably, the liquid component is substantially liquid in that at least 90%, more preferably at least 95%, %, more preferably at least 98% ingredients comprised by the liquid component are in a liquid form at room temperature.

Solid Component

If present, the solid component is comprised by a compartment of the pouch. Preferably, said compartment is a different compartment to the compartment that comprises the liquid component.

Said solid component preferably comprises (by weight of the solid component) at least 10%, more preferably at least 20%, more preferably at least 30% water-insoluble solid material.

Preferably, said water-insoluble solid material includes water-insoluble building agents, preferably the water-insoluble building agent is an aluminosilicate, or water-insoluble fabric softening agent such as clay. Preferably, said water-insoluble solid material comprises a water-insoluble building agent. Preferred water-insoluble building agents are described in more detail hereinafter.

Said solid composition preferably comprises at least one detergent ingredient selected from the group consisting of building agent, chelating agent, bleaching agent, bleach activator, enzyme, brightener, suds suppressor and dye. Preferably, said detergent ingredient is in the form of a solid.

It may even be possible that part or all of the ingredients of the solid component are not pre-granulated, such as agglomerated, spray-dried, extruded, prior to incorporation into the compartment, and that the component is a mixture of dry-mixed powder ingredients or even raw materials. Preferred may be that for example less than 60% or even less than 40% or even less than 20% of the component is a free-flowable pre-granulated granules.

Preferably the solid component is substantially solid in that at least 90%, preferably at least 95%, more preferably at least 98% of the ingredients comprised by the solid component are in a solid form. Preferably the solid component comprises ingredients that are either difficult or costly to include in a substantially liquid composition or that are typically transported and supplied as solid ingredients which require additional processing steps to enable them to be included in a substantially liquid composition.

Preferred Ingredients of the Liquid and Solid Components

The composition herein typically comprises ingredients. These ingredients are described hereinafter. The composition may comprises a liquid component and a solid component. Typically, ingredients that are preferably manufactured and processed in a solid form are comprised by the solid component and ingredients that are preferably manufactured and processed in a liquid form are comprised by the liquid component. The preferred amounts of ingredients described herein are % by weight of the composition herein as a whole and not % by weight of either the solid component or liquid component which may comprise said ingredient.

Water Insoluble Building Agent

The composition herein preferably comprises a water-insoluble building agent. Preferably the water-insoluble building agent is comprised by the solid component. Preferably the water-insoluble building agent is in solid form. Examples of water insoluble builders include the sodium aluminosilicates. The aluminosilicate material may be in hydrated form and are preferably crystalline, containing from 10% to 28%, more preferably from 18% to 22% water in bound form. The aluminosilicate zeolites can be naturally occurring materials, but are preferably synthetically derived. Synthetic crystalline aluminosilicate ion exchange materials are available under the designations Zeolite A, Zeolite B, Zeolite P, Zeolite X, Zeolite HS and mixtures thereof.

Chelating Agents

The composition herein, preferably comprises a chelating agent. By heavy chelating agent it is meant herein components which act to sequester (chelate) heavy metal ions. These components may also have calcium and magnesium chelation capacity, but preferentially they show selectivity to binding heavy metal ions such as iron, manganese and copper. Chelating agents are generally present at a level of from 0.05% to 2%, preferably from 0.1% to 1.5%, more preferably from 0.25% to 1.2% and most preferably from 0.5% to 1% by weight of the composition herein. Suitable chelating agents for use herein include organic phosphonates, such as the amino alkylene poly (alkylene phosphonates), alkali metal ethane 1-hydroxy bisphosphonates and nitrilo trimethylene phosphonates. Preferred among the above species are diethylene triamine penta (methylene phosphonate), ethylene diamine tri (methylene phosphonate) hexamethylene diamine tetra (methylene phosphonate) and hydroxy-ethylene 1,1 diphosphonate. Other suitable chelating agents for use herein include nitrilotriacetic acid and polyaminocarboxylic acids such as ethylenediaminotetracetic acid, ethylenetriamine pentacetic acid, ethylenediamine disuccinic acid, ethylenediamine diglutaric acid, 2-hydroxypropylenediamine disuccinic acid or any salts thereof. Especially preferred is ethylenediamine-N,N'-disuccinic acid (EDDS) or the alkali metal, alkaline earth metal, ammonium, or substituted ammonium salts thereof, or mixtures thereof.

Detersive Surfactants

Nonionic Alkoxylated Surfactant

Essentially any alkoxylated nonionic surfactants can be comprised by the composition herein. The ethoxylated and propoxylated nonionic surfactants are preferred. Preferred alkoxylated surfactants can be selected from the classes of the nonionic condensates of alkyl phenols, nonionic ethoxylated alcohols, nonionic ethoxylated/propoxylated fatty alcohols, nonionic ethoxylate/propoxylate condensates with propylene glycol, and the nonionic ethoxylate condensation products with propylene oxide/ethylene diamine adducts.

Highly preferred are nonionic alkoxylated alcohol surfactants, being the condensation products of aliphatic alcohols with from 1 to 75 moles of alkylene oxide, in particular about 50 or from 1 to 15 moles, preferably to 11 moles, particularly ethylene oxide and/or propylene oxide, are highly preferred nonionic surfactants. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from 2 to 9 moles and in particular 3 or 5 moles, of ethylene oxide per mole of alcohol.

Nonionic Polyhydroxy Fatty Acid Amide Surfactant

Polyhydroxy fatty acid amides are highly preferred nonionic surfactant comprised by the composition herein. A highly preferred nonionic polyhydroxy fatty acid amide surfactant for use herein is a $C_{12}$–$C_{14}$, a $C_{15}$–$C_{17}$ and/or $C_{16}$–$C_{18}$ alkyl N-methyl glucamide. It may be particularly preferred that the composition herein comprises a mixture of a $C_{12}$–$C_{18}$ alkyl N-methyl glucamide and condensation products of an alcohol having an alkyl group containing from 8 to 20 carbon atoms with from 2 to 9 moles and in particular 3 or 5 moles, of ethylene oxide per mole of alcohol.

Other Preferred Nonionic Surfactants

Fatty acid amide surfactants or alkoxylated fatty acid amides can also be comprised by the composition herein. Alkyl esters of fatty acids can also be comprised by the composition herein. Alkylpolysaccharides can also be comprised by the composition herein, such as those having a hydrophobic group containing from 6 to 30 carbon atoms and a polysaccharide, e.g., a polyglycoside, hydrophilic group containing from 1.3 to 10 saccharide units.

Polyethylene/Propylene Glycols

The composition herein may comprise polyethylene and/or propylene glycol, particularly those of molecular weight 1000–10000, more particularly 2000 to 8000 and most preferably about 4000.

Anionic Surfactant

The composition herein, preferably comprises one or more anionic surfactants. Any anionic surfactant useful for detersive purposes is suitable. Examples include salts (including, for example, sodium, potassium, ammonium, and substituted ammonium salts such as mono-, di- and triethanolamine salts) of the anionic sulphate, sulphonate, carboxylate and sarcosinate surfactants. Anionic sulphate surfactants are preferred.

Anionic sulphate surfactants suitable for use herein include the linear and branched primary and secondary alkyl sulphates, alkyl ethoxysulphates, fatty oleoyl glycerol sulphates, alkyl phenol ethylene oxide ether sulphates, the $C_5$–$C_{17}$ acyl-N—($C_1$–$C_4$ alkyl) and —N—($C_1$–$C_2$ hydroxyalkyl) glucamine sulphates, and sulphates of alkylpolysaccharides such as the sulphates of alkylpolyglucoside (the nonionic non-sulphated compounds being described herein). Alkyl sulphate surfactants are preferably selected from the linear and branched primary $C_9$–$C_{22}$ alkyl sulphates, more preferably the $C_{11}$–$C_{15}$ branched chain alkyl sulphates and the $C_{12}$–$C_{14}$ linear chain alkyl sulphates.

Anionic sulphonate surfactants suitable for use herein include the salts of $C_5$–$C_{20}$ linear or branched alkylbenzene sulphonates, alkyl ester sulphonates, in particular methyl ester sulphonates, $C_6$–$C_{22}$ primary or secondary alkane sulphonates, $C_6$–$C_{24}$ olefin sulphonates, sulphonated polycarboxylic acids, alkyl glycerol sulphonates, fatty acyl glycerol sulphonates, fatty oleyl glycerol sulphonates, and any mixtures thereof.

Other suitable anionic surfactants are the alkali metal sarcosinates. Preferred examples are the myristyl and oleoyl methyl sarcosinates in the form of their sodium salts.

Cationic Surfactant

Another preferred surfactant is a cationic surfactant, which may preferably be present at a level of from 0.1% to 60% by weight of the composition herein, more preferably from 0.4% to 20%, most preferably from 0.5% to 5% by weight of the composition herein.

When present, the ratio of the anionic surfactant to the cationic surfactant is preferably from 35:1 to 1:3, more preferably from 15:1 to 1:1. most preferably from 10:1 to 1:1.

Preferably the cationic surfactant is selected from the group consisting of cationic ester surfactants, cationic mono-alkoxylated amine surfactants, cationic bis-alkoxylated amine surfactants and mixtures thereof.

Suitable amphoteric surfactants for use herein include the amine oxide surfactants and the alkyl amphocarboxylic acids. Preferred amine oxides are $C_{10}$–$C_{18}$ alkyl dimethylamine oxide, and $C_{10-18}$ acylamido alkyl dimethylamine oxide. A suitable example of an alkyl aphodicarboxylic acid is Miranol(TM) C2M Conc. manufactured by Miranol, Inc., Dayton, N.J.

Zwitterionic Surfactant

Zwitterionic surfactants can also be comprised by the composition herein. These surfactants can be broadly described as derivatives of secondary and tertiary amines, derivatives of heterocyclic secondary and tertiary amines, or derivatives of quaternary ammonium, quaternary phosphonium or tertiary sulfonium compounds. Betaine and sultaine surfactants are exemplary zwitterionic surfactants for use herein. Complex betaine surfactants are also suitable for use herein.

Water-Soluble Building Agent

The composition herein may comprises a water-soluble building agent, typically present at a level of from 0% to 36% by weight, preferably from 1% to 35% by weight, more preferably from 10% to 35%, even more preferably from 12% to 30% by weight of the composition or particle. Preferably, the water-soluble builder compound is an alkali or earth alkali metal salt of phosphate present at the level described above. Other typical water-soluble building agents include the water soluble monomeric polycarboxylates, or their acid forms, homo or copolymeric polycarboxylic acids or their salts in which the polycarboxylic acid comprises at least two carboxylic radicals separated from each other by not more that two carbon atoms, borates, phosphates, and mixtures of any of the foregoing. Suitable examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerisation ranges from about 6 to 21, and salts of phytic acid.

Peroxide Source

Another preferred ingredient is a perhydrate bleach, such as salts of percarbonates, particularly the sodium salts, and/or organic peroxyacid bleach precursor. It has been found that when the pouch or compartment is formed from a material with free hydroxy groups, such as PVA, the preferred bleaching agent comprises a percarbonate salt and is preferably free form any perborate salts or borate salts. It has been found that borates and perborates interact with these hydroxy-containing materials and reduce the dissolution of the materials and also result in reduced performance. Inorganic perhydrate salts are a preferred source of peroxide. Preferably these salts are present at a level of from 0.01% to 50% by weight, more preferably of from 0.5% to 30% by weight of the composition or component. Examples of inorganic perhydrate salts include percarbonate, perphosphate, persulfate and persilicate salts. The inorganic perhydrate salts are normally the alkali metal salts. The inorganic perhydrate salt may be included as the crystalline solid without additional protection. For certain perhydrate salts however, the preferred executions of such granular compositions utilise a coated form of the material which provides better storage stability for the perhydrate salt in the granular product. Alkali metal percarbonates, particularly sodium percarbonate are preferred perhydrates herein. Sodium percarbonate is an addition compound having a formula corresponding to $2Na_2CO_3.3H_2O_2$, and is available commercially as a crystalline solid. Potassium peroxymonopersulfate is another inorganic perhydrate salt of use in the compositions herein.

Bleach Activator

The composition herein preferably comprises a bleach activator, preferably comprising an organic peroxyacid bleach precursor. It may be preferred that the composition comprises at least two peroxy acid bleach precursors, preferably at least one hydrophobic peroxyacid bleach precursor and at least one hydrophilic peroxy acid bleach precursor, as defined herein. The production of the organic peroxyacid occurs then by an in situ reaction of the precursor with a source of hydrogen peroxide. The bleach activator may alternatively, or in addition comprise a preformed peroxy acid bleach. The hydrophobic peroxy acid bleach precursor preferably comprises a compound having a oxy-benzene sulphonate group, preferably NOBS, DOBS, LOBS and/ or NACA-OBS, as described herein. The hydrophilic peroxy acid bleach precursor preferably comprises TAED, as described herein.

Organic Peroxyacid Bleaching System

The composition herein preferably comprises an organic peroxyacid precursor. The production of the organic peroxyacid may occur by an in situ reaction of such a precursor with the percarbonate source. In an alternative preferred execution a pre-formed organic peroxyacid is incorporated directly into the composition.

Peroxyacid bleach precursors are compounds which react with hydrogen peroxide in a perhydrolysis reaction to produce a peroxyacid. Amide substituted alkyl peroxyacid precursor compounds are also suitable for use herein.

Pre-formed Organic Peroxyacid

The organic peroxyacid bleaching system may contain a pre-formed organic peroxyacid. Preferred organic peroxyacids include diacyl and tetraacylperoxides, especially diperoxydodecanedioc acid, diperoxytetradecanedioc acid and diperoxyhexadecanedioc acid. Mono- and diperazelaic acid, mono- and diperbrassylic acid and N-phthaloylaminoperoxicaproic acid are also suitable herein.

Enzyme

Another preferred optional ingredient useful in the composition herein, is one or more additional enzymes. Preferred additional enzymatic materials include the commercially available lipases, cutinases, amylases, neutral and alkaline proteases, esterases, cellulases, pectinases, lactases and peroxidases conventionally incorporated into compositions.

Preferred commercially available protease enzymes include those sold under the tradenames Alcalase, Savinase, Primase, Durazym, and Esperase by Novo Industries A/S (Denmark), those sold under the tradename Maxatase, Maxacal and Maxapem by Gist-Brocades, those sold by Genencor International, and those sold under the tradename Opticlean and Optimase by Solvay Enzymes. Protease enzyme may be incorporated into the composition herein at a level of from 0.0001% to 4% active enzyme by weight of the composition.

Preferred amylases include for example, those sold under the tradename Rapidase by Gist-Brocades, and those sold under the tradename Termamyl and BAN by Novo Industries A/S. Amylase enzyme may be incorporated into the composition herein at a level of from 0.0001% to 2% active enzyme by weight of the composition.

Lipolytic enzyme may be present at levels of active lipolytic enzyme of from 0.0001% to 10% by weight of the particle, preferably 0.001% to 3% by weight of the composition, most preferably from 0.001% to 0.5% by weight of the compositions. preferred lipase is commercially available from Novo Industri A/S, Bagsvaerd, Denmark, under the trade name Lipolase.

Suds Suppressing System

The composition may comprise a suds suppresser at a level less than 10%, preferably 0.001% to 10%, preferably from 0.01% to 8%, most preferably from 0.05% to 5%, by weight of the composition Preferably the suds suppresser is either a soap, paraffin, wax, or any combination thereof. If the suds suppresser is a suds suppressing silicone, then the detergent composition preferably comprises from 0.005% to 0.5% by weight a suds suppressing silicone.

Particularly preferred suds suppressers are silicone antifoam compounds defined herein as any antifoam compound including a silicone component. Preferred silicone antifoam compounds are the siloxanes, particularly the polydimethylsiloxanes having trimethylsilyl end blocking units. Other suitable antifoam compounds include the monocarboxylic fatty acids and soluble salts thereof.

Polymeric Dye Transfer Inhibiting Agents

The composition herein may also comprise from 0.01% to 10%, preferably from 0.05% to 0.5% by weight of polymeric dye transfer inhibiting agents. These polymeric agents are in addition to the polymeric material of the water-soluble film. The polymeric dye transfer inhibiting agents are preferably selected from polyamine N-oxide polymers, copolymers of N-vinylpyrrolidone and N-vinylimidazole, polyvinylpyrrolidonepolymers or combinations thereof.

Optical Brightener

The composition herein may also optionally comprise from 0.005% to 5% by weight of certain types of hydrophilic optical brighteners.

A preferred optical brightener is 4,4',-bis[(4-anilino-6-(N-2-bis-hydroxyethyl)-s-triazine-2-yl)amino]-2,2'-stilbenedisulfonic acid and disodium salt, which is marketed under the tradename Tinopal-UNPA-GX by Ciba-Geigy Corporation. Tinopal-UNPA-GX is the preferred hydrophilic optical brightener useful in the compositions herein. Another preferred brightener is 4,4'-bis[(4-anilino-6-(N-2-hydroxyethyl-N-methylamino)-s-triazine-2-yl)amino]2,2'-stilbenedisulfonic acid disodium salt, which is commercially marketed under the tradename Tinopal 5BM-GX by Ciba-Geigy Corporation. Also, 4,4'-bis[(4-anilino-6-morphilino-s-triazine-2-yl)amino]2,2'-stilbenedisulfonic acid, sodium salt, is a preferred optical brightener and is marketed under the tradename Tinopal AMS-GX by Ciba Geigy Corporation.

Cationic Fabric Softening Agents

Cationic fabric softening agents are preferably present in the composition herein. Suitable cationic fabric softening agents include the water insoluble tertiary amines or dilong chain amide materials. Preferably, these water-insoluble tertiary amines or dilong chain amide materials are comprised by the solid component of the composition herein. Cationic fabric softening agents are typically incorporated at total levels of from 0.5% to 15% by weight, normally from 1% to 5% by weight.

Other Optional Ingredients

Other optional ingredients suitable for inclusion in the composition herein include perfumes, colours and filler salts, with sodium sulphate being a preferred filler salt.

Laundry Washing Method

Preferably, the multi-compartment pouch dissolves or disintegrates in water to deliver the solid detergent ingredients and liquid detergent ingredients to the washing cycle. Typically, the multi-compartment pouch is added to the dispensing draw, or alternatively to the drum, of an automatic washing machine.

Preferably, the multi-compartment pouch comprises all of the detergent ingredients of the detergent composition used in the washing. Although it may be preferred that some detergent ingredients are not comprised by the multi-compartment pouch and are added to the washing cycle separately. In addition, one or more detergent compositions other than the detergent composition comprised by the multi-compartment pouch can be used during the laundering process, such that said detergent composition comprised by the multi-compartment pouch is used as a pre-treatment, main-treatment, post-treatment or a combination thereof during such a laundering process.

EXAMPLES

Example I

A piece of Chris-Craft M-8630 film is placed on top of a small mold and fixed in place. The small mold consists of a hemispherical shape and has a diameter of 33 mm and a depth of 14.5 mm. A 1 mm thick layer of rubber is present around the edges of the mold. The mold has some holes in the mold material to allow a vacuum to be applied A vacuum is applied to pull the film into the mold and pull the film flush with the inner surface of the mold. 5 ml of the liquid component of a detergent composition is poured into the mold. Next, a second piece of Chris-Craft M-8630 film is placed over the top of the small mold with the liquid component and sealed to the first piece of film by applying an annular piece of flat metal of an inner diameter of 34 mm and heating that metal under moderate pressure onto the ring of rubber at the edge of the mold to heat-seal the two pieces of film together to form a pre-sealed compartment comprising the liquid component. The metal ring is typically heated to a temperature of from 135° C. to 150° C. and applied for up to 5 seconds. The pre-sealed compartment has a 75 mm rim of Chris-Craft film which extends in an outwardly direction from the seal away from the centre of the pre-sealed compartment so that the pre-sealed compartment can be fixed into place and completely cover the opening of a mold with a larger diameter of 48.5 mm.

Next, a third piece of Chris-Craft M-8630 film is placed on top of a larger mold and fixed in place. The large mold consists of a cylindrical shape and has a diameter of 48.5 mm and a depth of 22 mm. A 1 mm thick layer of rubber is present around the edges of the mold. The mold has some holes in the mold material to allow a vacuum to be applied A vacuum is applied to pull the film into the large mold and pull the film flush with the inner surface of the mold to form an open compartment. 40 g of the solid component of the detergent composition is poured into the open compartment.

Next, the pre-sealed compartment is placed over the top of the large mold with the solid component and fixed into place so that the pre-sealed compartment covers the opening of the large mold and the rim of film of the pre-sealed compartment is suitably placed over the layer of rubber which is present around the edges of the large mold so that the rim of film can form part of the seal which closes the open compartment.

The rim of film of the pre-sealed compartment is sealed to the third layer of film by applying an annular piece of flat metal of an inner diameter of 50 mm and heating that metal under moderate pressure onto the ring of rubber at the edge of the mold to heat-seal the pieces of film together to form a pouch comprising two compartments, where a first compartment comprises the liquid component of the detergent composition and a second compartment comprises the solid component of the detergent composition. The metal ring is typically heated to a temperature of from 135° C. to 150° C. and applied for up to 5 seconds.

Example II

A pouch was made by the process described in example I which comprises the following liquid component and solid component.

| Liquid component detergent ingredient | Amount (by weight of the liquid component) |
|---|---|
| Nonionic surfactant | 74% |
| Solvent | 12% |
| Perfume | 7% |
| Water | 2% |
| Minors | to 100% |

| Solid component detergent ingredient | Amount (by weight of the solid component) |
|---|---|
| Cationic surfactant | 5% |
| Bleaching agent | 26% |
| Chelating agent | 0.8% |
| Enzyme | 6% |
| Suds suppressor | 1% |
| Bleach activator | 12% |
| Sodium carbonate | 6% |
| Soap | 1% |
| Brightener | 0.5% |
| Zeolite | 40% |
| Minors | to 100% |

Example III

A pouch was made by the process described in example I which comprises the following liquid component and solid component.

| Liquid component detergent ingredient | Amount (by weight of the solid component) |
|---|---|
| Nonionic surfactant | 69% |
| Solvent | 9% |
| Perfume | 10% |
| Water | 3% |
| Minors | to 100% |

| Solid component detergent ingredient | Amount (by weight of the solid component) |
|---|---|
| Bleaching agent | 36% |
| Chelating agent | 2% |
| Enzyme | 10% |
| Suds suppressor | 1% |
| Sodium carbonate | 6% |
| Brightener | 3% |
| Zeolite | 40% |
| Minors | to 100% |

What is claimed is:

1. A multi-compartment pouch containing a detergent composition, said pouch being made from a water-soluble film and having at least two compartments, wherein said multi-compartment pouch comprises a first, pre-sealed compartment containing a detergent component, said pre-sealed compartment having a first seal, with a rim of said film extending in an outwardly direction from said seal away from the center of said pre-sealed compartment, said first seal and rim forming a second seal on a second compartment containing a detergent component, which second seal is in a different position to said first seal of the pre-sealed compartment, wherein the diameter of said second seal is longer than the diameter of said first seal.

2. A multi-compartment pouch according to claim 1, whereby said pre-sealed compartment comprises a liquid component.

3. A multi-compartment pouch according to claim 2, whereby the liquid component comprises at least 50%, by weight of the liquid component, of a surfactant.

4. A multi-compartment pouch according to claim 3, whereby the surfactant is a nonionic surfactant.

5. A multi-compartment pouch according to claim 2, whereby said pre-sealed compartment comprises an air bubble.

6. A multi-compartment pouch according to claim 1 wherein a liquid component is contained within a first compartment; a solid component is contained within a second compartment; the liquid component comprises at least one surfactant; and the solid component comprises at least one detergent ingredient.

7. A multi-compartment pouch according to claim 6 wherein less than 60%, by weight, of the solid component comprises free-flowable pre-granulated granules.

8. A multi-compartment pouch according to claim 6 wherein the surfactant is a nonionic surfactant.

9. A multi-compartment pouch according to claim 6 wherein the water-soluble film is comprised of polyvinyl alcohol.

* * * * *